United States Patent [19]

Schneider

[11] 4,167,850

[45] Sep. 18, 1979

[54] ELECTRONIC WATCH APPARATUS

[75] Inventor: Mark R. Schneider, San Jose, Calif.

[73] Assignee: Fairchild Camera and Instrument Corporation, Mountain View, Calif.

[21] Appl. No.: 822,762

[22] Filed: Aug. 8, 1977

[51] Int. Cl.[2] ..... G04B 29/04

[52] U.S. Cl. ..... 58/88 R; 58/93

[58] Field of Search ..... 58/63, 73, 88 R, 88 B, 58/92, 93; 200/296; 248/27; 24/208 A

[56] References Cited

U.S. PATENT DOCUMENTS

| | | | |
|---|---|---|---|
| 3,401,434 | 9/1968 | Daddona | 24/208 A |
| 3,492,809 | 2/1970 | Gisiger-Lusa | 58/88 R |
| 3,689,962 | 9/1972 | Erickson | 24/208 A |
| 3,729,780 | 5/1973 | White | 24/208 A |
| 4,034,552 | 7/1977 | Davidson | 58/88 R |

*Primary Examiner*—Gene Z. Rubinson
*Assistant Examiner*—Leonard W. Pojunas, Jr.
*Attorney, Agent, or Firm*—Alan H. MacPherson; Paul J. Winters

[57] ABSTRACT

A watch case and band in combination comprising a back portion containing on the outer periphery thereof first locking means; a center portion comprising a portion of the band containing therein an opening sufficient in size to allow a watch module to pass therethrough and having in the outer periphery of the band around said opening a plurality of smaller openings in alignment with said first locking means; and a top portion having in the outer periphery thereof second locking means located so as to mate with said first locking means locking through said plurality of smaller openings in said band.

9 Claims, 3 Drawing Figures

ELECTRONIC WATCH APPARATUS

BACKGROUND OF THE INVENTION

1. Field of the Invention

This invention relates to digital watches and in particular to a method for manufacturing and assembling a low-cost electronic watch and the resulting structure.

2. Prior Art

One of the problems in the volume manufacture of electronic watches is to obtain as low a manufacturing cost as possible commensurate with quality and aesthetic standards. Various structures and methods have been proposed to do this. For example, in co-pending patent application Ser. No. 788,866 filed Apr. 19, 1977 entitled "LOW COST WATCH CASE", on an invention of Schneider and Wickwar, assigned to the assignee of this application, an integral watch case and band is disclosed which comprises one way of achieving this goal. A switch means is provided as an integral part of the case sidewall for selectively actuating certain functions in the watch.

SUMMARY OF THE INVENTION

This invention provides another structure for achieving a low-cost electronic watch (either digital or analog) while at the same time meeting the high standards of quality and aesthetic appearance demanded by the consumer.

According to this invention, a three-part watch case means comprises a top means containing lens means formed in the center portion thereof and first lock means formed in the peripheral portions thereof; flexible band means containing a centered region with a center hole therein of a size sufficient to allow the insertion and passage of a watch module and battery, and containing in the periphery of said centered region selected holes in alignment with said first lock means in said top portion, and optionally containing as an integral part thereof at least one portion of the periphery of said centered region adapted to function as a push pin, and bottom means containing a recessed portion for receipt of a watch module and battery and containing in the outer periphery second lock means adapted to mate with the first lock means in the top means through the holes in said band means, wherein said structure in combination comprises a watch case means with band means adapted both to function as a gasket between said top means and said bottom means and as the band holding said watch case means on the arm of the user. The structure of this invention is particularly adapted for use as the case of a digital watch but can also be adapted for use with a conventional watch movement if desired.

As a feature of this invention, the flexible band means functions both as a water resistant gasket and the watch band. In addition, the band means can contain a push pin formed integrally from a portion of the band material directly adjacent a switch formed in the watch module. A watch module particularly suited for use with the watch case of this invention with the integral push pin is described in co-pending patent application Ser. No. 711,016 filed Aug. 9, 1976 on an invention of Duff et al entitled: "STRUCTURE AND METHOD OF MAKING A LOW COST SHOCK RESISTANT WATCH", and assigned to Fairchild Camera and Instrument Corporation, the assignee of this application. As disclosed in that application, the use of a module function switch of the type there described makes possible the use of electrically nonconductive material for the push button activating the function switch in the module. This commensurately reduces the cost of the material in the button and the cost of fabricating and assembling the button into the finished watch.

DETAILED DESCRIPTION

Figure 1:
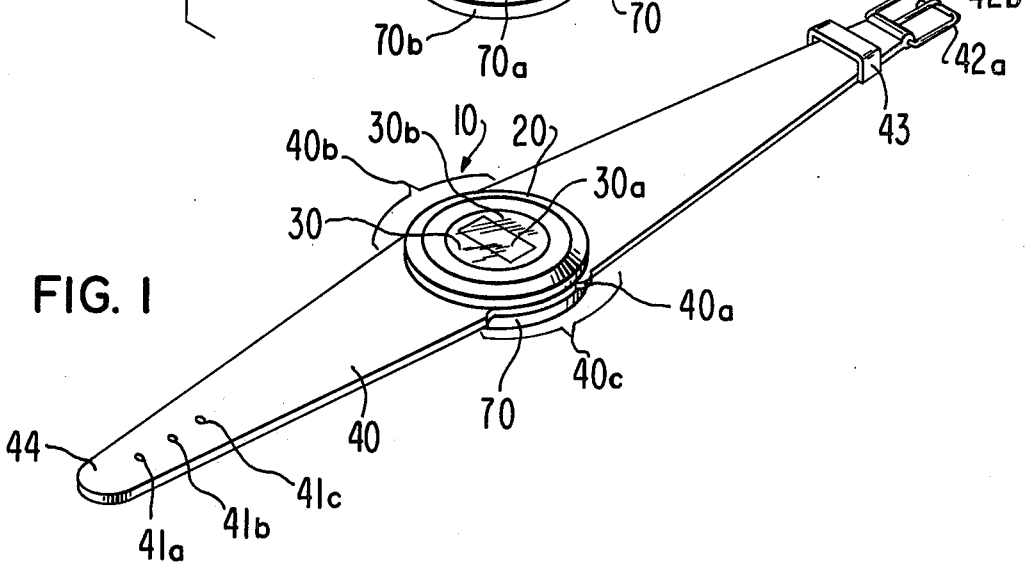
FIG. 1 shows a perspective view of one possible watch assembled in accordance with the method of this invention to yield the structure of this invention.

FIG. 1 shows a typical watch 10 possessing the structure of this invention and constructed in accordance with the method of this invention. Watch 10 comprises a top means or bezel 20 of any desired aesthetic appearance in which is inserted a lens 30. When used with a digital watch, typical lens 30 comprises a clear transparent portion **30*a* through which the digits in the watch module can be read and an opaque portion 30*b* formed either by joining a metal plate to the back surface of the transparent lens or by silk screening the desired pattern onto the back surface of the lens. Of course any other appropriate method of forming the desired pattern on the lens can be used as desired. When used with an analog watch, lens 30** is usually clear.

As a feature of this invention, band 40 is formed as an integral part of the watch case. Peripheral portions **40*b* and 40*c* of the center region of the band (the "center region" of the band comprises that portion of the band directly beneath bezel 20) are formed such that their exterior shapes have the same outer dimensions as the directly adjacent outer portions of the bezel 20. The interior of the center region of the band directly beneath at least part of the lens portion of bezel 20 has an opening formed therein sufficient to allow watch module 60** (of any standard construction but particularly of a construction such as disclosed in above-mentioned co-pending application Ser. No. 711,016) to pass through said opening so as to be properly located within the case.

Bottom means 70 (also called the "back"), is of a unique construction particularly adapted for use with the structure of this invention. Case back 70 is formed with a recess **70*a* in the center portion thereof for receipt of battery 80 and watch module 60. Recess 70*a* could also receive a conventional watch movement. Peripheral portion 70*b* has formed on the top surface thereof pin 71-1 through 71-N where "N" is an integer representing the number of pins formed on the periphery of the back 70. In one embodiment, four pins are sufficient and N equals four. Any other desired number of pins can, of course, be used. Pins 71-n (where "n" is any integer between 1 and N) are formed integrally with 70. Typically back 70 is formed by injection molding using a moldable metal such as zamic. Any other metal (such as powdered metal) capable of being injection molded and suitable for use as a watch cause can, of course, be used. Similarly, a plastic material capable of being molded can also be used in place of the metal parts of the case. The pins or lugs 71-n protruding from the pheripery of the back are formed with a taper such that when a lug 71-n is inserted into a corresponding hole formed in the periphery of bezel 20, the lug locks firmly in this hole preventing bezel 20 from being removed from back 70 except by use of a special tool. While pins 71 are shown formed as part of back 70 these pins could alternatively be formed as part of bezel 20 and holes 21-n could be formed as part of back 70 instead of in bezel 20**, as shown.

Band 40 has holes 44-1 through 44-N (corresponding to the lugs 71-1 through 71-N) formed in the portions of the band directly above back 70 and beneath bezel 20. During the assembly of the structure (as shown in exploded view in FIG. 3), holes 44-n are located in alignment with lugs 71-n. Lugs 71-n are then inserted into corresponding holes 21-n formed in the adjacent surface of bezel 20.

Figure 3:
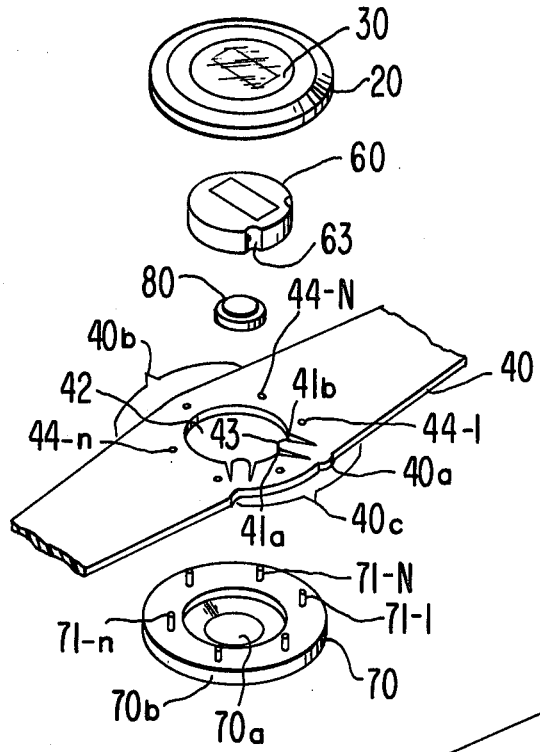
FIG. 3 shows a perspective exploded view of the structure shown in FIG. 1.
Figure 2:
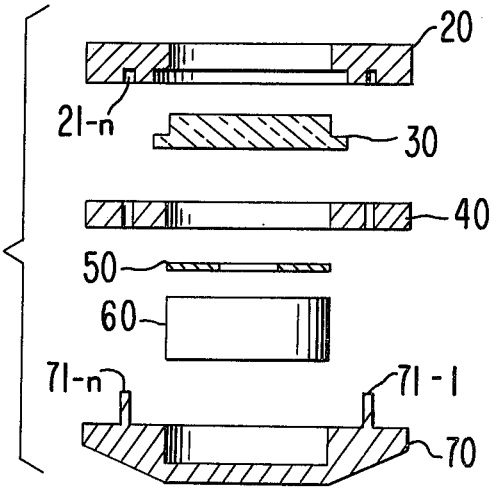
FIG. 2 shows a cross-sectional exploded view of the structure of FIG. 1.

FIG. 2 shows in cross-section the exploded view of the components shown assembled in FIG. 1 and in perspective exploded view in FIG. 3. As shown in FIG. 2, lugs 71-n insert directly into openings 21-n formed in the bottom surface of bezel 20. Lugs 71-n have a taper such that these lugs lock in holes 21-n.

A particular feature of this invention is that the center region (including peripheral regions 40*b* and 40*c*) of the band 40 located between back 70 and bezel 20 functions not only as a water resistant gasket but, if desired, as least one portion of this center region can also function as a push pin. This portion (shown in FIG. 3), comprises a protuberance 40*a* extending beyond the side of bezel 20 and back 70 together with indentations 41*a* and 41*b* formed from the interior opening 42 into the side 40*c* of the band material. These indentations give to that portion of material 43 between the indentations 41*a* and 41*b* an improved flexibility for lateral movement. In addition the interior point of material 43 extends into the opening 42 beyond the normal perimeter of this opening to make touch contact with the switch 63 on the side of module 60. Slight pressure on the protuberance 40*a* by the user is sufficient to laterally move point 43 inward (i.e. toward the module 60) a small distance (such as one one hundredth of an inch) to activate the switch 63 on the side of module 60.

Of importance, any flexible plastic or other material can be used for watch band 40. Band 40 (other that that portion which comprises part of the case) is a standard watch band containing openings 41*a*, 41*b* and 41*c* (more openings if desired) which mate with the tongue 42*b* of buckle 42*a*. Sleeve 43 then receives the portion of tongue 44 which extends beyond buckle 42*a*. That portion of band 40 between bezel 20 and bottom 70 also serves as a gasket, making the case of this invention water resistant.

The watch module 60 can be either a LED and LCD display or any other kind of display appropriate for use with digital or electronic watches. The lens can be either glass or plastic of any desired color. An electronic module with which this particular case structure is best used is a module having a switch of the type disclosed in application Ser. No. 711,016 wherein the case does not have to serve as an integral part of the electrical circuit connected to the switch.

An alternate improvement of this invention eliminates the gasket between bezel 20 and back 70, with the back 70 on the bezel 20 on both containing protrusions suitable for the attachment of a conventional watch band.

What is claimed is:

1. A watch case and band comprising; a back means containing on the outer periphery thereof first means for locking; a band means having a center portion containing therein an opening sufficient in size to allow a watch module to pass therethrough and having in the periphery thereof around said opening a plurality of smaller openings in alignment with said first means for locking; and a top means having in the outer perphery thereof second means for locking located so as to mate with said first means for locking through said plurality of openings in said band means, wherein said band means includes in a side wall portion thereof directly adjacent to switch means on said module a protruberance which functions as a push pin for operating said switch means.

2. Structure as in claim 1 wherein said top means includes lens means formed in the center portion of said top means so as to allow a user to view the display on a watch module located between said back means and said top means.

3. Structure as in claim 1 wherein said band means includes means for attaching said structure to the wrist of a user.

4. Structure as in claim 1 wherein said back means includes a recepticle for receipt of a battery and watch module.

5. Structure as in claim 1 wherein said band means comprises a flexible material.

6. Structure as in claim 1 wherein said band means comprises a flexible material suitable for functioning as a continuous gasket between said back means and said top means.

7. A watch band with a center portion thereof adapted to function as a gasket between a top and a back of a watch case, wherein said center portion comprises a center region having an opening therein and an outside peripheral portion surrounding said opening, the outer perimeter of said peripheral portion adapted to conform to the shape of the outside perimeter of the top and including a plurality of the openings for the passage of lock means to hold said top to said back, wherein said peripheral portion of said watch band includes a portion specifically adapted to function as a push button for activating a switch on a watch module.

8. Structure as in claim 7 wherein said push button comprises a portion of said peripheral portion of said watch band, said portion having a first protuberance extending beyond the outside perimeter of said top and a second protuberance extending into the opening in the center of the watch band so as to activate said switch in response to an inward motion of said protuberance.

9. Structure as in claim 8 wherein those portions of the peripheral portion directly adjacent the push button and the opening in the center portion of said band are partially removed to increase the lateral flexibility of said push button.

* * * * *